United States Patent [19]

Soubry et al.

[11] Patent Number: 4,480,716

[45] Date of Patent: Nov. 6, 1984

[54] HIGH RISE ESCAPE DEVICE

[76] Inventors: Garry V. Soubry, 4316 Marina City Dr., Marina Del Rey, Calif. 90291; James L. MacFarlane, 5848 Sinaloa Ct., Las Vegas, Nev. 89103

[21] Appl. No.: 500,977

[22] Filed: Jun. 3, 1983

[51] Int. Cl.[3] ..... A62B 1/12; A62B 1/16

[52] U.S. Cl. ..... 182/233; 182/238

[58] Field of Search ..... 182/5, 6, 7, 233, 231, 182/238, 236; 188/290, 268

[56] References Cited

U.S. PATENT DOCUMENTS

| | | | |
|---|---|---|---|
| 439,191 | 10/1890 | Roper | 182/238 |
| 516,117 | 3/1894 | Roper | 182/238 |
| 614,855 | 11/1898 | Franklin | 182/238 |
| 2,585,876 | 2/1952 | Thoennes | 182/5 |
| 2,607,548 | 8/1952 | Hollander | 188/290 |
| 2,729,425 | 1/1956 | Gschwind | 182/5 |
| 3,865,216 | 2/1975 | Gryglas | 188/290 |
| 3,879,016 | 4/1975 | Kankkunen | 182/238 |
| 4,088,201 | 5/1978 | MacFarlane | 182/5 |
| 4,098,375 | 7/1978 | Kornylak | 188/290 |
| 4,359,945 | 11/1982 | Brew | 188/290 |

*Primary Examiner*—Reinaldo P. Machado

*Attorney, Agent, or Firm*—Seiler, Quirk, & Tratos

[57] ABSTRACT

A casing incorporates a spool having a cable wound thereon. One end of the cable is fixed to the spool and the other end passes from the casing. A safety belt is secured to the casing and arranged to support a human body. The extending free end of the cable terminates in a hook or other device for attaching the same to a high rise building. In the event of fire or other emergency, a person can lower himself by paying out the cable from the casing. Appropriate viscous fluid in the casing provides a drag so that the rate of descent is controlled.

5 Claims, 6 Drawing Figures

HIGH RISE ESCAPE DEVICE

FIELD OF THE INVENTION

This invention relates generally to fire escape devices and more particularly to an improved portable device by which a person may lower himself from a high rise building to the ground.

BACKGROUND OF THE INVENTION

Most deaths in high rise building fires occur on upper stories beyond the reach of conventional fire truck ladders. In attempting to minimize such deaths, various portable type reel and line devices have been proposed which can be used by an individual in a high rise building to lower himself to the ground by paying out the line or cable from the reel.

Notwithstanding that many types of portable safety line reel type fire escape devices have been proposed, there has not, to the best of our knowledge, really been any widely accepted use of the same.

Part of the problem is that the devices themselves as have been proposed in the past are relatively expensive and are not always foolproof in operation. For example, many such devices rely on a mechanical device to provide a retarding force or frictional drag on the reel in order to slow the rate of descent of a person to a safe value. It is difficult to adjust such mechanical devices to provide a proper degree of friction. If there is too little friction, a person will drop too quickly and can be seriously injured when striking the ground. If there is too much friction, the person cannot descend rapidly enough to escape the fire.

In U.S. Pat. No. 4,088,201 there is disclosed a greatly improved fire escape safety line and reel or spool arrangement utilizing a viscous fluid as a retardant or frictional drag on the spool. More particularly, the spool on which a line or cable is wound is enclosed within a casing. The casing itself includes a side housing or extended portion in an axial direction and serves to house a rotatable member on the same shaft as that supporting the spool. As the cable unwinds, this rotatable member will rotate within the auxiliary housing. An appropriate viscous fluid is provided in the housing to result in a frictional drag on the member and thus the spool thereby controlling the rate of descent of a person.

The device itself is in the form of a casing arranged to be secured to a projection or hook or other member embedded in a high rise building. The free end of the cable from the casing in turn connects to an appropriate safety belt or harness supporting the person who is attempting to escape. The cable itself is payed out from a peripheral opening on the casing. After the person is lowered to the ground, he or she simply disconnects the free end of the cable.

While this device as covered in the patent represents a great advance in the art in that a very controlled descent is realized, there are still some problems. First, the device can only be used once since the casing intself is secured to the building and ultimately would be destroyed by a fire. Second, the provision of the auxiliary housing on the casing makes the device somewhat more bulky than would be desirable in the design of a portable escape device. Finally, the tangential opening through which the free end of the cable passes from the casing is such that if a load on the cable is suddenly relieved, part of the cable may "jump" back into the casing and possibly cause a jamming of the spool. In this respect, it will be appreciated that the cable is under tension when supporting a human body and if the weight of the body is suddenly relieved as might occur if the person descending encountered a ledge, the elasticity of the cable could result in the same "jumping" back into the casing resulting in the aforesaid entanglement.

The above-noted U.S. patent and the various references cited therein constitute the closest prior art of which we are aware to the present invention.

BRIEF DESCRIPTION OF THE PRESENT INVENTION

With the foregoing considerations in mind, the present invention contemplates an even further improved portable escape device for high rise buildings wherein certain of the problems associated with prior devices as discussed above are overcome.

More particularly, the present invention provides for a more compact casing while still taking advantage of a viscous fluid retardant system. In its broadest aspects, the invention comprises a casing, a spool rotatably mounted in the casing, a cable on the spool with one end fixed to the spool and a free end passing out of the casing so that a person can be lowered from a high rise by paying out of said cable from the casing. The spool has a hollow interior and a member is fixed relative to the spool and disposed in this hollow interior. The spacing between the exterior of the member and the interior of the spool defines an annular passage. Viscous fluid fills this passage to provide frictional force on the spool to retard rotation of the spool so that a person may be lowered at a safe rate of descent from a high rise.

In a preferred embodiment, the exit slot through which the free end of the cable passes from the casing has marginal edges of resilient material spaced to define a width less than the diameter of the cable so that a frictional drag is exerted on the cable. By this arrangement, backward movement of the cable into the casing upon sudden release of a load on the cable is inhibited.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
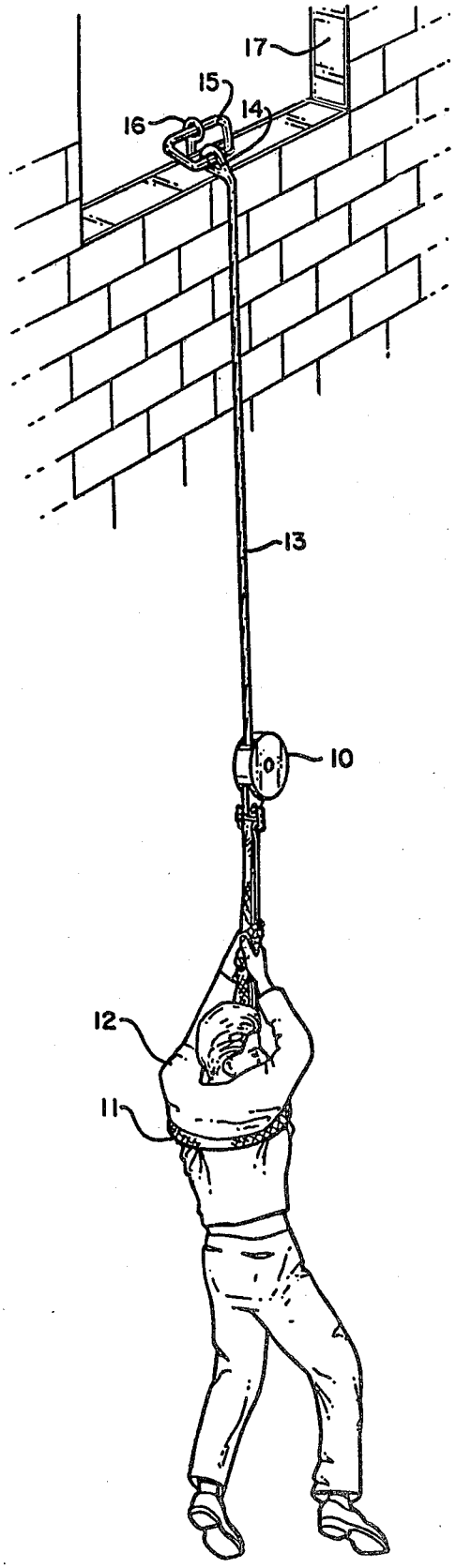
FIG. 1 is a fragmentary perspective view of a window in a high rise and a person escaping by means of the escape device of this invention.

Referring first to FIG. 1, the escape device includes a casing 10 together with means in the form of a belt 11 secured to the casing for carrying a person 12 escaping from a high rise.

A cable 13 is payed out from the casing 10 as the person 12 lowers himself. The free end of the cable is shown at 14 and includes an attachment means 15 for securing the cable to the high rise. For example, this attachment can be connected to member 16 adjacent to a window area 17 for the high rise.

Figure 2:
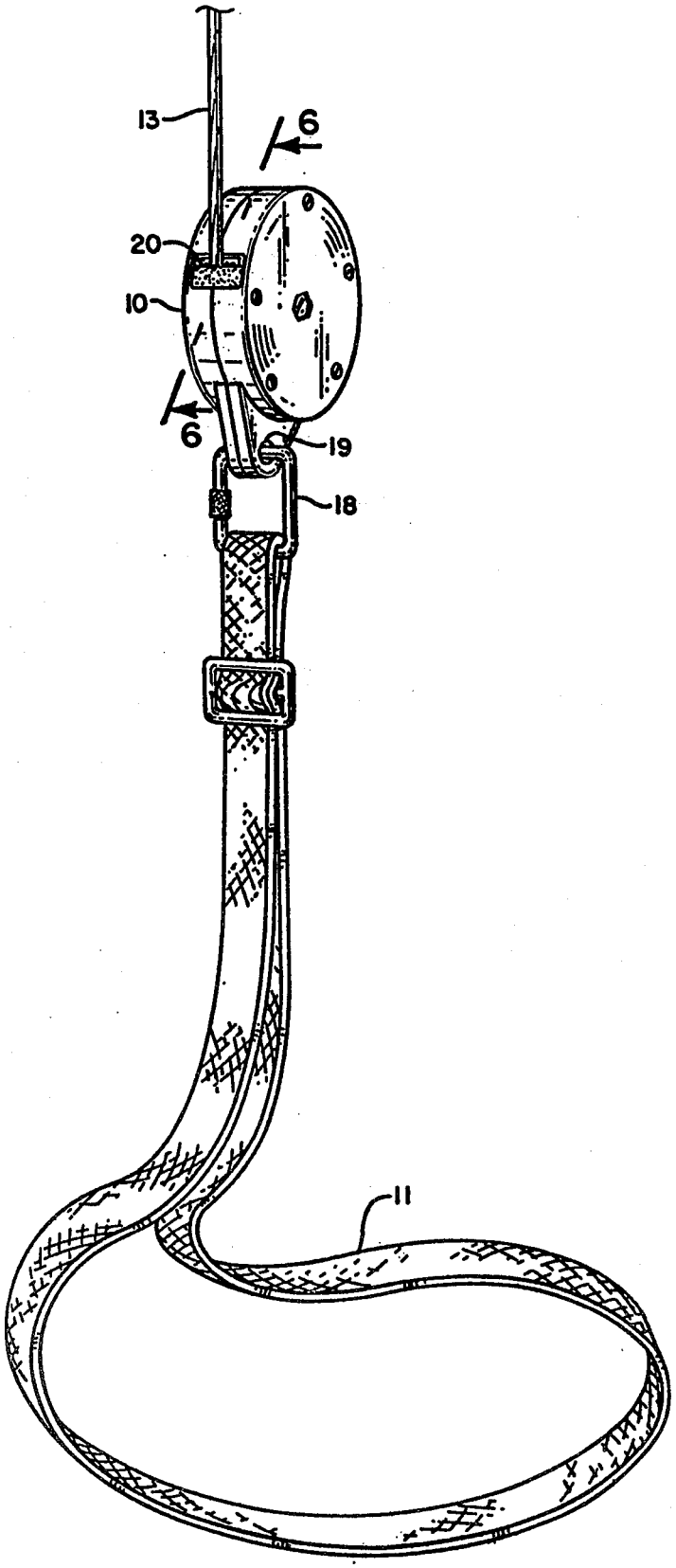
FIG. 2 is a greatly enlarged perspective view of the escape device itself employed by the escaping person in FIG. 1.

Referring to the enlarged view of FIG. 2, there is shown an attachment buckle 18 for the belt 11 passing through registering eyes on integral attaching means 19 extending from the casing 10. A transverse exit slot 20 is also shown in FIG. 2 for the casing 10, from which the cable 13 passes.

Figure 3:
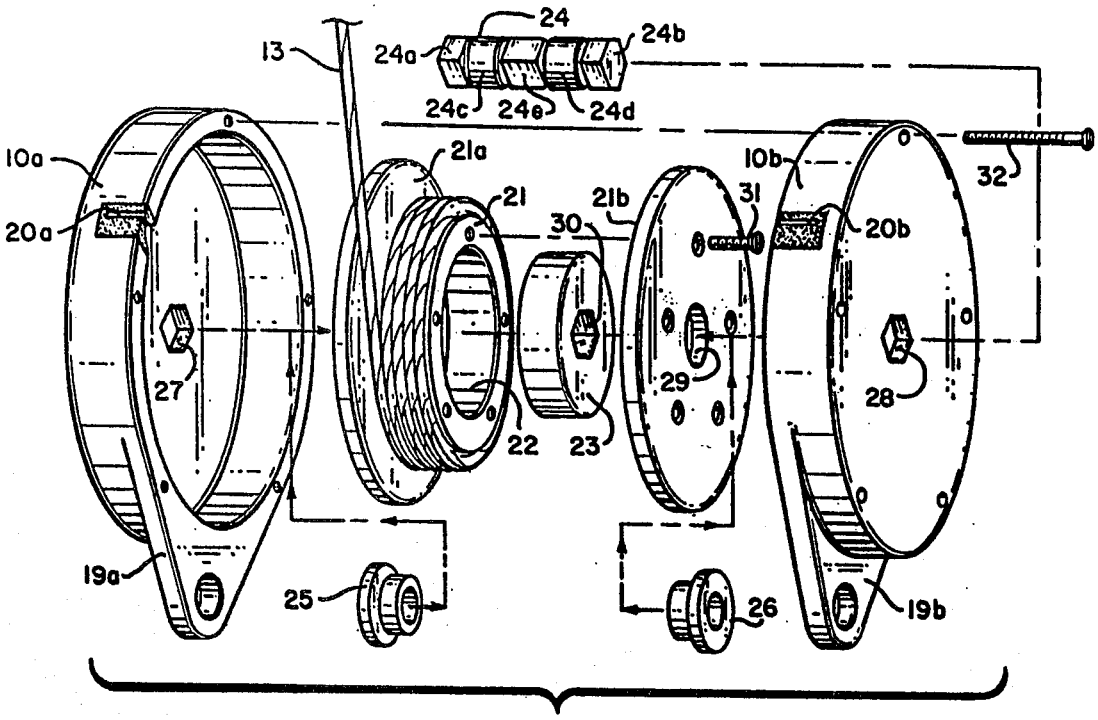
FIG. 3 is an exploded perspective view of the basic components making up the escape device of this invention.

Referring now to FIG. 3, details of the various components making up the casing 10 of FIG. 2 will be evident. As shown in FIG. 3, the casing 10 itself is comprised of first and second half portions 10*a* and 10*b*. The integral attachment means described in FIG. 2 are made up of half portions 19*a* and 19*b*. Similarly, the exit slot 20 is formed by slot half portions 20*a* and 20*b*.

Within the casing, there is provided a spool shown at 21 having spool sides or flange portions 21*a* and 21*b* when in assembled relationship. The interior of the spool 21 is hollow, as indicated at 22. Cable 13 wraps around the spool as shown.

A member 23 arranged to be fixed within the hollow interior 22 is provided and has an exterior surface corresponding in overall configuration to the interior surface of the hollow interior 22 of the spool but of slightly lesser dimensions to define an annular passage of constant volume between the exterior surface of the member and the interior surface of the spool. This constant volume will be described in detail subsequently.

A fixed shaft 24 shown exploded above the various components in FIG. 3 passes axially through the spool 21 and member 30 and has its opposite ends secured to the opposing interior walls of the casing half portions 10*a* and 10*b*. More particularly, these opposing ends of the shaft 24 are indicated at 24*a* and 24*b*. Spaced inwardly from these opposite ends are circular portions indicated at 24*c* and 24*d* which cooperate with plastic sleeves shown at 25 and 26 in the lower portion of FIG. 3 to rotatably support the spool 21. The central portion of the shaft 24 is shown at 24*e* and is fixed to the member 23.

It will be noted in FIG. 3 that the half portions of the casing 10*a* and 10*b* have hexagonal openings 27 and 28 in their opposing side walls. These hexagonal openings are arranged to be receive the corresponding hexagonal ends 24*a* and 24*b* of the shaft so that the shaft 24 is rotationally locked to the casing.

The spool flanges are provided with round openings such as indicated at 29 for the flange 21*b* which receives the plastic sleeves such as the plastic sleeve 26. In other words, these plastic sleeves serve as journals for rotatably mounting the spool, the shaft 24 remaining rotationally fixed.

The central portion 24*e* is shown as also hexagonally shaped in FIG. 3, the same being received within a correspondingly hexagonally shaped opening 30 in the member 23 so that this member is held fixed within the hollow interior 22 of the spool 21.

Still referring to FIG. 3, the flange 21*b* of the spool 21 is secured to the spool as by screws 31 while the first and second casing halves 10*a* and 10*b* can be secured together by screws such as indicated at 32. Only one such screw is shown for the spool and one such screw for the casing halves but it will be understood that there would be a plurality of tapped openings for receiving a corresponding number of screws about the periphery of the spool flange and about the periphery of the casing half.

Figure 4:
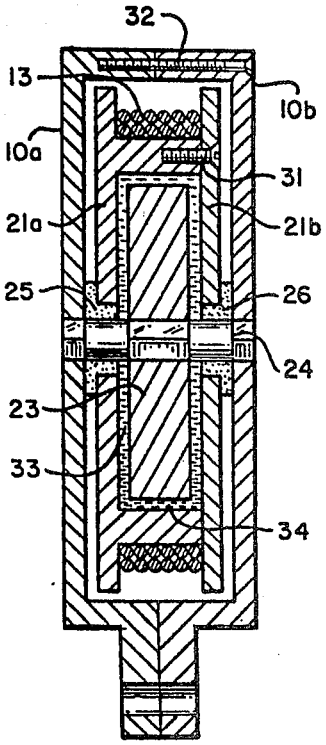
FIG. 4 is a cross section of the various components illustrated in FIG. 3 in assembled relationship.

Referring now to FIG. 4, the various components described in FIG. 3 are shown in assembled relationship in cross section. In FIG. 4, it will be noted that the plastic sleeves 25 and 26 rotationally mount the spool sides or flanges 21*a* and 21*b*. Further, the fixed member 23 is shown in the interior of the spool fixed to the shaft as a consequence of the hexagonal configuration.

The slightly smaller outer dimensions of the fixed member 23 relative to the interior of the spool briefly described in FIG. 3 results in the formation of an annular passage indicated at 33 in FIG. 4 of constant cross section. This annular passage is filled with an appropriate viscous fluid; for example, dimethyl siloxane. Typically, this viscous fluid might have a viscosity of between $0.65\times10^6$ and $2.0\times10^6$ centistokes.

The viscous fluid will exert a retardant action on the hollow interior surfaces of the spool forming the outer walls of the annular passage 33. The specific dimensioning provides for opposed ares of sufficient size that when a specific viscous fluid of a given viscosity is used, the rate of descent of a person of average weight is at a safe speed. As a typical example of a device, the outer casing 10 might typically have a diameter of approximately 7½ inches. The diameter of the annular passage 33 in turn, might be 5 inches. The width of the annular passage; that is, the distance between the spool flanges 21*a* and 21*b*, might typically be 1½ inches.

It will be appreciated that one of the factors determining the retardant force on the spool exerted by the viscous fluid is the size of the opposed areas between the fixed member 23 and the interior surface of the spool.

Figure 5:
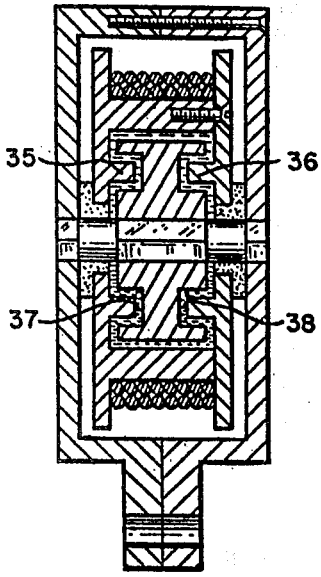
FIG. 5 is another cross section similar to FIG. 4 but illustrating an alternative embodiment of the invention.

FIG. 5 illustrates in cross section a modified configuration of the spool and member to provide opposed areas defining the annular passage, the same as the opposed areas in FIG. 4 but wherein the diameter of the casing and spool have been reduced to provide a more compact unit. Thus, in FIG. 4 part of the interior surface of the spool is cylindrical with the axis of the cylinder coaxial with the axis of rotation of the spool. The remaining parts are flat surfaces normal to the axis of the cylinder as defined by the inner central surfaces of the sides of flanges of the spool, the member 23 constituting a solid toroidal body coaxial with the axis of the cylinder.

In the case of FIG. 5, the remaining parts include flat surfaces normal to the axis of the cylinder defined by inner central surface portions of the sides of the spool together with annular ribs indicated at 35 and 36 extending towards each other from the sides or flanges of the spool. The member in turn is provided with annular grooves 37 and 38 receiving these ribs.

It will be evident from the configuration of FIG. 5 that the overall opposing surface areas defining the annular passage between the exterior surfaces of the member and the interior surfaces of the spool are greater than would be the surface areas in the absence of the ribs and grooves. As a consequence, and as mentioned heretofore, a given retarding action on the spool can thus be effected with smaller overall dimensions for the casing and spool.

Figure 6:
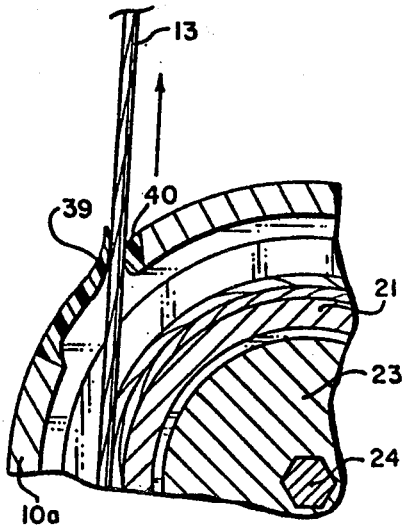
FIG. 6 is an enlarged fragmentary cross section of the device taken in the direction of the arrow 6—6 of FIG. 2.

Referring now to the cross section of FIG. 6, there is shown in greater detail the exit slot 20 through which the free end of the cable 13 passes. As shown, the marginal edges 39 and 40 of this slot are of resilient material and spaced to define a width less than the diameter of the cable. As a result, a frictional drag is exerted on the cable as it is being payed out of the slot to thereby inhibit back movement of the cable into the interior of the casing.

OPERATION

In operation, the portable escape device may be provided in each room of a high rise hotel or in each apartment of a high rise apartment building. In some instances, a person can even carry the portable device around with him throughout his travels.

In the event of a fire or emergency wherein escape from the high rise is necessary, the free end 14 with its attached means 15 of the cable 13 is quickly secured to a permanent part of the high rise adjacent to a window or other means for gaining access to the exterior of the building. The entrapped person then quickly secures the supporting belt 11 about his waist and then carefully lowers himself, the cable 13 simply being payed out from the casing 10.

The rate of rotation of the spool within the casing 10 is accurately controlled by the viscous fluid filling the annular passage described in conjunction with FIG. 4. This viscous fluid will exert a drag on the interior wall surfaces of the spool as these wall surfaces move relative to the fixed member 23. The drag is such that a safe rate of descent of the person is assured.

By modifying the cross section of the annular passage to define an interleaved shape as shown in FIG. 5, the surface areas defined by the exterior of the fixed member and the interior of the spool can be made the same as the opposed areas of the FIG. 4 embodiment but within a smaller diameter casing as described heretofore. Alternatively, the same diameter casing can be employed with a smaller interior volume for the spool so that a greater cable length can be accommodated on the exterior of the spool between the side flanges.

With respect to the foregoing, cable lengths from 75 ft. to 360 ft. and greater are available so that the device will enable escape from high rises as high as 100 stories.

After a person has been safely lowered to the ground, the cable may simply be cut from the casing itself or the casing opened up and the cable detached from the spool. A new cable can then be wound on the spool and the same casing used again in the event of another emergency.

From all of the foregoing, it will now be evident that the present invention has provided a greatly improved portable escape device for high rise buildings.

We claim:

1. A portable device for enabling a person to escape from a high rise building, comprising, in combination:

(a) an enclosed casing having substantially flat, parallel exterior walls;

(b) means secured to the casing for carrying said person;

(c) a spool rotatably mounted in said casing, said spool having a hollow interior chamber defined by walls;

(d) a cable carried on said spool with one end fixed to the spool and a free end passing out of said casing;

(e) means for attaching said free end to said high rise building so that said cable will be payed out from said spool as said casing and person descend;

(f) a fixed member in said hollow interior chamber of said spool having a plurality of flat exterior surfaces mounted in close proximity to corresponding flat parallel chamber wall surfaces, defining annular passages of constant volume between said exterior surfaces of said member and interior surfaces of said spool;

(g) a fixed shaft passing axially through said spool and having opposite ends secured to said opposing interior walls, the central portion of said shaft being secured to said member to hold it in fixed position rotationally and laterally, and plastic sleeve means for journalling said spool to said shaft for rotation and simultaneously acting as bearing means and providing sealing between said annular passage and exterior of said spool; and (h) a viscous fluid completely filling said annular passage for retarding rotating of said spool by exerting a viscous friction force on the interior walls of said spool.

2. A portable device according to claim 1, in which part of the interior of said spool is cylindrical with the axis of the cylinder coaxial with the axis of rotation of the spool the remaining parts being flat surfaces normal to the axis of the cylinder and defined by the inner central surfaces of the sides of the spool, said member constituting a solid toroidal body coaxial with said axis of said cylinder.

3. A portable device according to claim 1, in which part of the interior surface of said spool is cylindrical with the axis of the cylinder coaxial with the axis of rotation of said spool, the remaining parts including flat surfaces normal to the axis of the cylinder and defined by inner central surface portions of the sides of the spool, and annular ribs extending towards each other from said sides, said member having a cylindrical periphery and flat sides with annular grooves therein receiving said ribs whereby the overall opposing surface areas defining the annular passage between the exterior surfaces of said member and the interior surface of said spool are greater than would be the surface areas in the absence of said ribs and grooves, whereby a given retarding action on said spool can be effected with smaller overall dimensions for said casing and spool.

4. A portable device according to claim 1, in which said casing includes an exit slot through which the free end of said cable passes, the marginal edges of the slot being of resilient material and spaced to define a width less than the diameter of said cable so that a frictional drag is exerted on said cable as it is being payed out of said slot to thereby inhibit back movement of said cable into the interior of said casing.

5. A portable device according to claim 1, in which the ends of said shaft are of hexagonal shape and the opposing interior walls of said casing include hexagonal openings for receiving said hexagonal shapes, the central portion of said shaft being of hexagonal shape, said member having a central opening of hexagonal shape receiving said central portion, and wherein the portions of said shaft surrounded by said plastic sleeve means are circular.

* * * * *